United States Patent [19]

Dolin

[11] Patent Number: 4,526,914

[45] Date of Patent: Jul. 2, 1985

[54] WHITEWATER FORMULATION CONTAINING A CATIONIC POLYACRYLAMIDE

[75] Inventor: Rick L. Dolin, Littleton, Colo.

[73] Assignee: Manville Service Corporation, Denver, Colo.

[21] Appl. No.: 561,624

[22] Filed: Dec. 15, 1983

[51] Int. Cl.[3] ..... D21D 3/00; D21H 3/46

[52] U.S. Cl. ..... 524/42; 524/44; 524/492; 524/494; 162/156; 162/168.3

[58] Field of Search ..... 524/42, 43, 44, 45, 524/492, 494; 162/146, 156, 168.3

[56] References Cited

U.S. PATENT DOCUMENTS 3,268,459 8/1966 Luck ..... 524/44
4,090,984 5/1978 Lin et al. ..... 524/43
4,302,367 11/1981 Cordes et al. ..... 524/45
4,395,524 7/1983 Emmons et al. ..... 524/555

*Primary Examiner*—Morton Foelak
*Assistant Examiner*—Nathan M. Nutter
*Attorney, Agent, or Firm*—John D. Lister; Cornelius P. Quinn; Richard K. Thomson

[57] ABSTRACT

A whitewater dispersant system containing a cationic surfactant and a cationic polyacrylamide. The viscosity modifier of the present invention may include amounts varying from 0 to 90% of a nonionic cellulosic viscosity modifier. The resulting whitewater is particularly effective in dispersing glass fibers in a slurry which is used to form a glass mat. The whitewater preferably has a viscosity lying in the range of from 2 to 12 cps and most preferably about 8 cps.

10 Claims, No Drawings

WHITEWATER FORMULATION CONTAINING A CATIONIC POLYACRYLAMIDE

BACKGROUND AND SUMMARY OF INVENTION

The present invention is directed to a whitewater dispersant formulation suitable for dispersing fibers in a slurry for deposition in a wet-laid mat process. More particularly, the present invention is directed to a whitewater formulation which contains a cationic polyacrylamide and is suitable for manufacturing a wet-laid mat of glass fibers.

Fiber glass mats are used as reinforcing elements for roofing shingles, flooring, wall coverings, and the like. One technique of manufacturing these mats is to disperse amounts of chopped-strand glass fibers in an aqueous slurry, collect the fibers on a foraminous belt using suction to dewater the slurry, apply a binder to the mat to provide the desired strength properties to the mat, and heat the binder-containing mat in an oven to drive off excess moisture and to cure the binder.

Certain properties of the mat, including tensile strength and, in some cases, the suitability of the mat for a particular application, will depend, in good measure, on how well the fibers are dispersed within the slurry. This ultimately determines the distribution of fibers in the mat, the quantity of holes or clumps in the mat, etc. The whitewater dispersant system plays the major role in achieving the desired fiber dispersion and distribution.

There are a number of traits desired in a whitewater dispersant system and these traits can be provided by the various components. Typically, a whitewater will include some level of surfactant to be deposited on the fibers to make them slip relative to one another. While certain amounts of surface treatments can be applied in the form of sizings as the fibers are made, additional surfactants are generally necessary to achieve proper dispersion of the fibers in the slurry. However, it is important that an excessive amount of surfactant not be applied to the fibers or their surfaces will be too slippery to be bonded together.

Another desired property of a whitewater dispersant system is a sufficiently high viscosity (e.g., from 2 to 12 cps, preferably around 8 cps.) to hold the fibers in suspension. To produce such a viscosity a "thickener" or viscosity modifier must be added. Any such viscosity modifier should be compatible with the other whitewater components. The surfaces of most glass fibers are generally slightly anionic. Accordingly, it is preferred that the surface treatments (sizings and surfactants) be cationic to form a better bond with the glass surfaces. Hence, it is important that the viscosity modifier be either nonionic or cationic so as not to react with and precipitate out the surfactant and not to react with the cationic sizing on the fibers causing them to flocculate.

A third desired property of whitewater need be stated in terms of what is not desired. If the ingredients create a large amount of foam (i.e., if the whitewater has a great deal of entrained air) particularly of the microbubble size, the foam tends to cause pumping difficulties including possible cavitation in, or other failure of, the moving parts of the pump. The microbubbles are particularly stable (i.e., difficult to deaerate). Typically, a defoamer will be used to try to decrease the level of air entrained in the whitewater.

The whitewater dispersant system of the present invention comprises a cationic surfactant and a cationic viscosity modifier in water. Various amounts of an additional viscosity modifier in the form of a nonionic hydroxyethyl cellulose may be added, preferably, from 50 to 75% of the total viscosity modifier present in the whitewater. As noted above, the cationic surfactant is preferred for its superior bonding to the anionic glass surface. The cationic viscosity modifier is wholly compatible with both the surfactant and the sized fibers. In addition, it was found that between 25 and 50% of the cationic polyacrylamide, when used in conjunction with 75 to 50% hydroxyethyl cellulose, significantly reduced the amount of air entrained into the whitewater and, hence, reduced pumping difficulties caused by such entrained air when circulating the large quantities of whitewater needed for wet process mat formation.

Various other features, characteristics and advantages of the present invention will become apparent after a reading of the following description.

DETAILED DESCRIPTION OF THE PREFERRED EMBODIMENTS

In developing the whitewater dispersant system of the present invention, three newly developed cationic polyacrylamides were tried. These three cationic polyacrylamides were obtained from Dow Chemical Company and were identified as experimental polymer emulsions XD 30597.00, XD 30584.01, and XD 30598.02 (XD 02). While the three samples provided similar results, the XD 02 sample proved most effective at increasing viscosity and was therefore chosen for sampling on the pilot mat machine. Each of the samples was provided as a water-in-oil emulsion containing 28–31% active polymer and was a copolymerization product of an acrylamide monomer and a cationic methacrylate.

The standard whitewater formulation utilized prior to the present invention employed a cationic surfactant available from American Cynamid under the name Aerosol C-61. This cationic surfactant is preferably present in amounts ranging from 50 to 300 parts per million (ppm) and most preferably about 150 ppm. Also used was a hydroxyethyl cellulose available from Hercules Inc. under the label Natrosol TM HHXR. These whitewater ingredients were incorporated into the dispersant system of the present invention. These products are exemplary of the cationic surfactants and hydroxyethyl cellulose products which may be used but the invention is not in any way limited thereto. Also used in both the former whitewater and that of the present invention was a commercial defoamer available from Diamond Shamrock and identified as Foamaster TM SZU.

The whitewater formulation used prior to the present invention comprised, in a 400 gallon solution, 1334 ppm Natrosol TM HHXR, 133 ppm cationic surfactant, and 10 cc defoaming agent. Because of the difficulty in hydrolizing Natrosol TM, it is added separately first to a portion of the water (250 gal.) and blended until well dispersed. Natrosol TM hydrolizes more easily if the pH is 8.0 or above so ammonia is added to the whitewater to raise the pH to at least 8.0. Once the Natrosol TM is hydrolized, if the pH exceeded 8.3, an acid, such as nitric acid (or acetic or phosphoric acids), would be used in quantities ranging from 20 to 50 cc to bring the alkalinity into the 7.5 to 8.0 range. While the cationic polyacrylamide can allegedly tolerate pH's ranging from 2 to 11, some problems with the cationic surfactant flocculating have been observed when the pH exceeds 8.3.

EXAMPLE I

In this first example, all of the Natrosol TM used in the previous whitewater formulation was replaced by an equal amount of XD 02. Into 250 gallons of water, 2000 grams of cationic polyacrylamide was blended as received. This amount of viscosity modifier is sufficient to raise the whitewater viscosity into the desired range between 2 and 12 centipoises (cps). The most preferred viscosity is about 8 cps. The pH was adjusted to below 8.3, as necessary using 20 cc of nitric acid. Then, 200 grams of cationic surfactant were blended in and sufficient water added to bring the total whitewater batch to 400 gallons. Since the cationic polyacrylamide had shown itself to be an effective defoamer, no separate defoamer was added to the mix. This whitewater and the Natrosol TM whitewater previously used were run on a pilot wet-laid mat machine to produce fiber glass mats.

A variety of sized fibers were used including both E glass fibers (designated sample A) and soft glass fibers (designated sample B). Both groups of fibers had average diameters falling in the range of 15.2 to 16.5 microns and a length of about one inch. A variety of different sizings were tried to determine what effect certain variations in sizing composition might have on the whitewater compatibility and the characteristics of final mat. These sizings, which all have a polyvinyl alcohol base, are considered highly proprietary in nature and will be referenced here only by post scripts 1,2,3, etc., to indicate like or different formulations.

The characteristics of a number of sized fibers in the Natrosol TM whitewater are provided in TABLE I for comparison with all three of the examples of the present invention to be presented. The mat characteristics for the single sized fiber run in this 100% cationic polyacrylamide viscosity modifier whitewater is also shown in TABLE I. Properties are measured in both the machine direction (MD) and the cross machine direction (CMD).

TABLE I

| | Natrosol TM Whitewater | | | | | |
|---|---|---|---|---|---|---|
| Fiber | A1 | A2 | A3 | B1 | B4 | 100% XD 02 A1 |
| Wt g/ft$^2$ | 9.1 | 9.56 | 8.38 | 8.82 | 8.83 | 8.96 |
| Binder content (LOI %) | 21.8 | 19.6 | 11.0 | 23.8 | 18.9 | 19.8 |
| Thickness (Mils) | 37 | 39 | 26 | 38 | 39 | 40 |
| Tensile Strength | | | | | | |
| Dry (lb/3 in)[1] MD | 120 | 127 | 38 | 108 | 103 | 128 |
| (lb/3 in) CMD | 109 | 118 | 35 | 106 | 83 | 111 |
| Wet[2] lb/3 in) CMD | 96 | 88 | 34 | 85 | 80 | 90 |
| 5' @ 70° F. (% of Dry) | 88 | 75 | 97 | 80 | 96 | 81 |
| Wet (lb/3 in) CMD | 90 | 85 | 20 | 71 | 58 | 73 |
| 10' @ 180° F. (% of Dry) | 83 | 72 | 57 | 67 | 69 | 66 |
| Mullen Burst (psi) | 58 | 65 | 21 | 53 | 57 | 58 |
| ASTM-D774 Elmendorf Tear MD (gms) | 530 | 550 | 230 | 412 | 494 | 412 |
| ASTM-D689 CMD (gms) | 467 | 532 | 236 | 407 | 500 | 437 |

[1]3 inch wide samples are used to test tensiles.
[2]Samples are soaked for 5 and 10 min respectively at the temperatures shown.

Although the 100% cationic polyacrylamide whitewater showed slightly lower Elmendorf tear resistance readings for the same fiber used in the Natrosol TM whitewater, these data do indicate that XD 02 is a viable one-for-one substitute for Natrosol TM as viscosity modifier in whitewater dispersant systems. Further, a cationic polyacrylamide of this type may make possible the reduction or elimination of separately added defoamer utilized. The A3 sample indicates the negative impact failure to maintain a sufficient binder content (as indicated by loss on ingnition, LOI %) can have on mat properties.

EXAMPLE 2

In the second whitewater example, a 75% cellulosic, 25% polyacrylamide viscosity modifier ratio was desired. Accordingly, 1500 grams of Natrosol TM was blended in 250 gallons of water until completely hydrolized. Due to the difficulty in hydrolizing Natrosol TM, ammonia was used to raise the pH to at least 8.0, as was done with the former whitewater formulation. Next, 500 grams of XD 02 was blended into the batch. The pH was again adjusted, if necessary, to be below 8.3 using nitric acid; (if the addition of ammonia brought the pH to less than 8.3, no acid addition should be necessary unless the recycling of processed water alters the pH). Next the water was increased to bring the batch to 400 gallons. Lastly, 10 cc of Foamaster SZU was added. This whitewater was then employed to disperse fibers in a wet-laid mat on the pilot machine. The properties of the resultant mat with a plurality of different sized fibers are shown in TABLE II.

TABLE II

| | 75% Natrosol/25% XD 02 | | | |
|---|---|---|---|---|
| Fiber | A1 | A2 | B1 | B3 |
| Wt g/ft$^2$ | 9.32 | 9.31 | 9.36 | 8.87 |
| Binder Content (LOI %) | 18.0 | 16.4 | 19.8 | 18.5 |
| Thickness (mils) | 38 | 34 | 39 | 38 |
| Tensile Strength | | | | |
| Dry (lb/3 in) MD | 116 | 117 | 110 | 118 |
| (lb/3 in) CMD | 108 | 102 | 95 | 109 |
| Wet (lb/3 in) CMD | 83 | 90 | 82 | 83 |
| 5' @ 70° F. (% of Dry) | 77 | 88 | 86 | 76 |
| Wet (lb/3 in) CMD | 72 | 68 | 67 | 66 |
| 10' @ 180° F. (% of Dry) | 67 | 67 | 71 | 61 |
| Mullen Burst (psi) | 63 | 66 | 58 | 58 |
| ASTM-D774 Elmendorf MD (gms) | 494 | 571 | 466 | 501 |
| Tear ASTM-D689 CMD (gms) | 486 | 619 | 469 | 533 |

Not only do the mat properties compare favorably with those of the Natrosol TM whitewater mat, an additional benefit was obtained. The entrained air in the Natrosol TM whitewater was measured at 5.5% (by volume). The modified formulation containing 25% polyacrylamide had entrained air levels of only 1%. Further, the nature of the entrained air changed from small-celled microbubbles to large-celled, rapidly deaerated bubbles. Pumping problems, including excessive cavitational wear on the rotor vanes, are much less of a potential problem with the whitewater of the present invention.

EXAMPLE III

A 50% cellulosic, 50% polyacrylamide whitewater was produced in order to determine what effect such a change might have. This example used 1000 grams of Natrosol TM and 1000 grams of XD 02 blended in accordance with the steps in the previous example. Two sized fibers were run on the pilot machine using this whitewater formulation. The properties of this mat are shown in TABLE III.

TABLE III

| Fiber | 50% Natrosol/50% XD 02 A1 | A2 |
|---|---|---|
| Wt g/ft$^2$ | 9.09 | 9.36 |
| Binder Content (LOI %) | 18.0 | 19.0 |
| Thickness (mils) | 37 | 36 |
| Tensile Strength | | |
| Dry (lb/3 in) MD | 114 | 131 |
| (lb/3 in) CMD | 107 | 123 |
| Wet (lb/3 in) CMD | 87 | 98 |
| 5' @ 70° F. | 81 | 80 |
| (% of Dry) | | |
| Wet (lb/3 in) CMD | 70 | 81 |
| 10' @ 180° F. | 65 | 66 |
| (% of Dry) | | |
| Mullen Burst (psi) | 65 | 66 |
| ASTM-D774 | 458 | 512 |
| Elmendorf MD (gms) | | |
| Tear ASTM-D689 CMD (gms) | 502 | 541 |

All mat properties were good for this whitewater system. In addition, the entrained air for this system was again measured at 1% by volume, displaying the same secondary benefit obtained in the 25% polyacrylamide example.

Various changes, alternatives and modifications will become apparent after a reading of the foregoing specification. For example, while the whitewater dispersant system has been described only in conjunction with glass mat, it is believed to be equally applicable to dispersing many other synthetic and natural fibers. Accordingly, it is intended that all such changes, alternatives and modifications as come within the scope of the appended claims be considered a part of the present invention.

I claim:

1. A whitewater dispersant system for use in dispersing anionic fibers in an aqueous slurry in a wet-laid mat process comprising a cationic surfactant present in sufficient quantity to prevent said fibers from abrading each other in said aqueous slurry, said surfactant being cationic to improve adhesion to the surface of the anionic fibers, a viscosity modifier system in sufficient quantity to bring the viscosity of the whitewater dispersant system into the range from 2 to 12 centipoises and prevent said fibers from prematurely settling out of said aqueous slurry, said viscosity modifier system including a polyacrylamide, said polyacrylamide being cationic so as to avoid precipitating said cationic surfactant out of the slurry and so as not to cause flocculation of the fibers coated with said cationic surfactant.

2. The whitewater dispersant system according to claim 1 further comprising a nonionic cellulosic viscosity modifier.

3. The whitewater dispersant system of claim 2 wherein the cellulosic viscosity modifier is a hydroxyethyl cellulose.

4. The whitewater dispersant system of claim 2 wherein the relative amounts of polyacrylamide and cellulosic viscosity modifiers vary from 10 to 100% by weight polyacrylamide and from 90 to 0% by weight cellulosic of the total amount of viscosity modifier in the whitewater system.

5. The whitewater dispersant system of claim 4 wherein the relative amounts of polyacrylamide and cellulosic viscosity modifiers more preferably vary from 25 to 50% by weight polyacrylamide and from 75 to 50% by weight cellulosic, respectively, of the total amount of viscosity modifier in the whitewater system.

6. The whitewater dispersant system of claim 5 wherein the level of cationic surfactant is more preferably in the range of 0.013 and 0.017 percent of the total weight of the whitewater system.

7. The whitewater dispersant system of claim 1 wherein the cationic polyacrylamide is a copolymerization product of an acrylamide monomer and a cationic methacrylate.

8. The whitewater dispersant system of claim 7 wherein the cationic polyacrylamide is provided as a water-in-oil emulsion containing 28 to 31% active polymer, by weight.

9. The whitewater dispersant system of claim 1 wherein the total viscosity modifier level is in the range from 0.075 to 0.2 percent of the total weight of the whitewater system.

10. A fiber glass mat product manufactured using a wet-laid mat process and the whitewater dispersant system of claim 1.

* * * * *